US007021735B2

(12) United States Patent
Spicer

(10) Patent No.: US 7,021,735 B2
(45) Date of Patent: Apr. 4, 2006

(54) REDUCTION OF COLOR PLANE ALIGNMENT ERROR IN A DRUM PRINTER

(75) Inventor: John Paul Spicer, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/402,451

(22) Filed: Mar. 28, 2003

(65) Prior Publication Data

US 2005/0275677 A1 Dec. 15, 2005

(51) Int. Cl.
*B41J 29/93* (2006.01)

(52) U.S. Cl. ..... 347/19

(58) Field of Classification Search ..... 347/5, 347/19, 38, 104, 105, 234–235, 248–250, 347/262, 264, 14; 345/165–166; 702/94, 702/150, 151; 700/56
See application file for complete search history.

(56) References Cited

U.S. PATENT DOCUMENTS

| | | | | |
|---|---|---|---|---|
| 4,591,969 | A | 5/1986 | Bloom et al. | 438/62 |
| 4,667,098 | A | 5/1987 | Everett | 250/231.14 |
| 4,739,346 | A | 4/1988 | Buckley | 346/138 |
| 4,806,034 | A | 2/1989 | Plummer | 400/279 |
| 4,891,690 | A | 1/1990 | Hasegawa et al. | 358/514 |
| 5,093,674 | A | 3/1992 | Storlie | 347/16 |
| 5,116,150 | A | 5/1992 | Courtney | 400/320 |
| 5,262,937 | A | 11/1993 | Mackin et al. | 347/232 |
| 5,287,162 | A | 2/1994 | de Jong et al. | 399/149 |
| 5,424,388 | A | 6/1995 | Chen et al. | 399/216 |
| 5,598,201 | A * | 1/1997 | Stodder et al. | 347/104 |
| 5,668,455 | A | 9/1997 | Gotz et al. | 318/602 |
| 5,677,686 | A * | 10/1997 | Kachi et al. | 341/8 |
| 5,737,216 | A * | 4/1998 | Hokari | 700/56 |
| 5,774,635 | A | 6/1998 | Kuusisto et al. | 358/1.6 |
| 5,809,380 | A | 9/1998 | Katakabe et al. | 399/227 |
| 5,871,292 | A | 2/1999 | Johnson et al. | 400/328 |
| 5,889,534 | A | 3/1999 | Johnson et al. | 347/19 |
| 5,909,235 | A | 6/1999 | Folkins | 347/240 |
| 5,978,005 | A | 11/1999 | Hadley | 347/177 |
| 5,984,470 | A | 11/1999 | Sakino et al. | 347/106 |
| 6,198,897 | B1 | 3/2001 | Ream | 399/301 |
| 6,290,319 | B1 | 9/2001 | Boleda et al. | 347/19 |
| 6,302,506 | B1 | 10/2001 | Norton | 347/14 |
| 6,304,825 | B1 * | 10/2001 | Nowak et al. | 702/94 |
| 6,322,184 | B1 | 11/2001 | Brenner et al. | 347/14 |
| 6,363,228 | B1 | 3/2002 | Ream | 399/66 |
| 6,371,593 | B1 | 4/2002 | Li et al. | 347/19 |

FOREIGN PATENT DOCUMENTS

| | | | |
|---|---|---|---|
| EP | 0 949 081 | A1 | 10/1999 |
| JP | 2001222200 | A | 8/2001 |

* cited by examiner

*Primary Examiner*—Hai Pham
(74) *Attorney, Agent, or Firm*—Taylor & Aust, P.C.

(57) ABSTRACT

An imaging system including a rotatable device configured for rotation, a memory including an error table having a plurality of error entries and a position detection apparatus coupled to the rotatable device, the position detection apparatus having at least one position sensor, the at least one position sensor producing a position signal, the position detection apparatus combining the position signal with at least one of the plurality of error entries of the error table, to thereby produce an output signal representative of a substantially true position of the rotatable device.

19 Claims, 6 Drawing Sheets

REDUCTION OF COLOR PLANE ALIGNMENT ERROR IN A DRUM PRINTER

BACKGROUND OF THE INVENTION

1. Field of the Invention

The present invention relates to a method and apparatus for the reduction of color plane alignment error in a printer, and, more particularly, to a method and apparatus for the reduction of color plane alignment error in a drum printer.

2. Description of the Related Art

A printer can include an intermediate transfer device, which transfers text and/or images therefrom to a print medium. An ink jet printer may contain an intermediate transfer member in the form of an intermediate transfer drum. To prepare for the image transfer process a coating assembly places a coating of fluid or gel onto a surface of the intermediate transfer drum. This fluid or gel has some degree of tackiness to it. A printhead is located approximate to the circumference of the intermediate transfer drum and an image is delivered to the fluid/gel layer by the printhead. As a sheet of print media enters into a transfer nip, formed by the intermediate transfer drum and a backing roll, the print media contacts the ink/gel, which becomes adhered to the surface of the print media.

Ink jet printers may contain multiple printheads each printhead assigned a particular color. Alignment between the printheads is crucial in order to achieve a quality image on the print media. In addition to the alignment of the printheads in an ink jet printer any misalignments of a transfer drum can lead to errors in the alignment of the ink droplets on the fluid/gel layer of the intermediate transfer drum. Misalignments due to manufacturing and the control of the intermediate transfer drum can result in errors that vary by in the angular position of the intermediate transfer drum.

What is needed in the art is a method to control the positional error in a drum of a printer.

SUMMARY OF THE INVENTION

The present invention provides an apparatus and method for reducing color plane alignment error in a drum printer.

The invention comprises, in one form thereof, an imaging system including a rotatable device configured for rotation, a memory including an error table having a plurality of error entries and a position detection apparatus coupled to the rotatable device, the position detection apparatus having at least one position sensor, the at least one position sensor producing a position signal, the position detection apparatus combining the position signal with at least one of the plurality of error entries of the error table, to thereby produce an output signal representative of a substantially true position of the rotatable device.

The invention comprises, in another form thereof, a method of generating an error table for use in a positioning system of a printer, including the steps of providing a rotatable device including an encoded element, moving the encoded element, detecting a plurality of positions of the encoded element by way of at least one sensor, producing a plurality of position signals corresponding respectively to each of the plurality of positions, calculating at least one positional error from the plurality of position signals and storing at least one positional error as an element in the error table.

The invention comprises, in another form thereof, a method of generating an error table for use in a positioning system of a printer including the steps of providing a rotatable device including an encoded element, moving the encoded element, detecting a position of the encoded element by way of at least one sensor including a first sensor, producing at least one signal from the first sensor, calculating at least one positional error from the at least one signal and storing the at least one positional error as an element in the error table.

An advantage of the present invention is that error in the alignment of a transfer drum in a printer is reduced.

Another advantage of the present invention is that alignment errors of a drum associated with a misaligned shaft are compensated for.

Yet another advantage of the present invention is that errors induced by any misalignment or off center positioning of an encoder wheel, associated with the intermediate transfer drum, is reduced.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
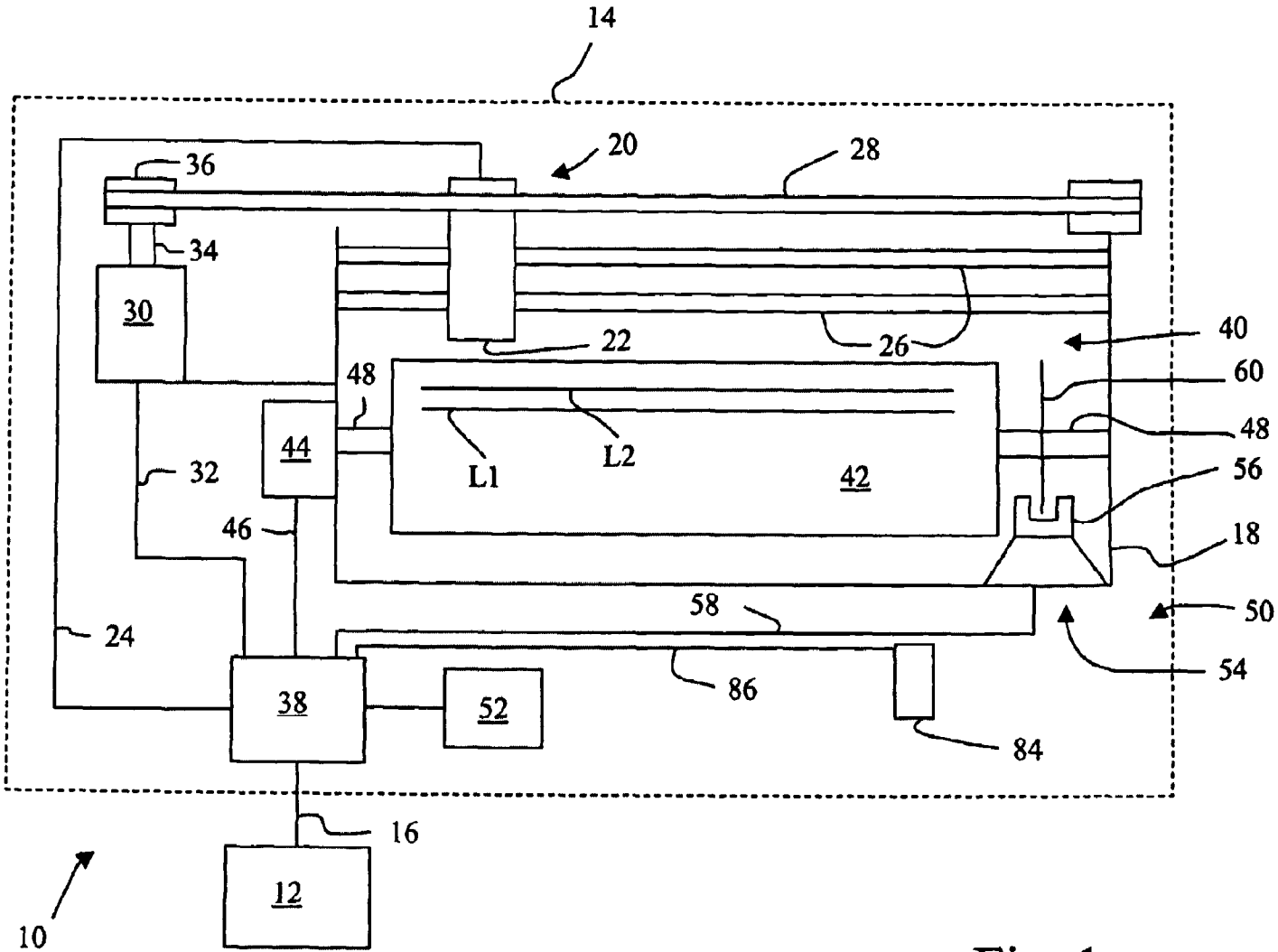
FIG. 1 is a diagrammatic representation of an imaging system having a printer with an embodiment of the color plane alignment error reducing method of the present invention.

Referring now to the drawings and particularly to FIG. 1, there is shown an imaging system 10 embodying the present invention. Imaging system 10 includes a computer 12, a printer 14 and a communication link 16. Computer 12 is communicatively coupled to printer 14, which may be in the form of an ink jet printer 14, by way of communications link 16. Communications link 16 may be, for example, an electrical, an optical or a network connection. Computer 12 is typical of that known in the art, and includes a display, an input device such as a keyboard, a processor and associated memory. Resident in the memory of computer 12 is printer driver software. The printer driver software places print data and print commands in the format that is recognized by ink jet printer 14. The print data and print commands are conveyed to printer 14 by way of communications link 16. Ink jet printer 14 responds to the print data and print commands conveyed to it from computer 12 and prints an image that is ultimately placed on a print media. Ink jet printer 14 includes a frame 18, a carrier 20, printhead assembly 22, a communications link 24, guide rods 26, a carrier transport belt 28, a carrier motor 30, a communications link 32, a carrier motor shaft 34, a driven pulley 36 and a controller 38.

Carrier 20 slides along guide rods 26 controllably carrying printhead assembly 22 in a bi-directional printing path. Carrier 20 is connected to transport belt 28 and is driven by carrier motor 30 by way of driven pulley 36 connected to carrier motor shaft 34. The speed and the direction of rotation of carrier motor shaft 34 is under the direction of controller 38.

Figure 2:
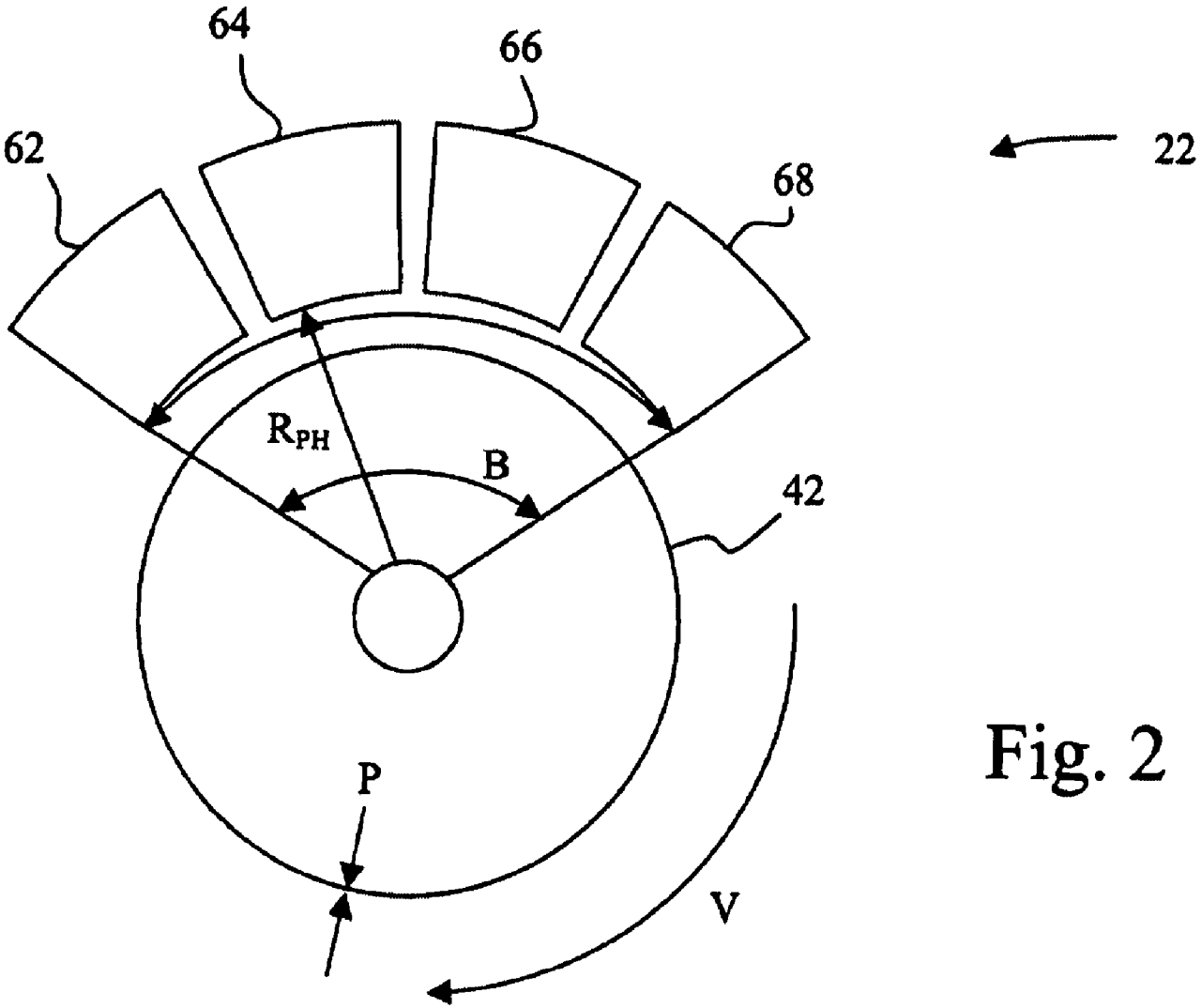
FIG. 2 is a cross-sectional view of an intermediate transfer drum and associated printheads of the printer of FIG. 1.

Now, additionally referring to FIG. 2, printhead assembly 22 includes a cyan printhead 62, a black printhead 64, a magenta printhead 66 and a yellow printhead 68. Printheads 62, 64, 66 and 68 are controllably moved and fired under the direction of controller 38. Printheads 62, 64, 66 and 68 are all connected to printhead assembly 22 in an aligned manner such that the nozzles of each of printheads 62, 64, 66 and 68 are aligned to each other. Alternatively, printhead assembly 22 may include a black ink printhead 64 and a multi-color ink printhead.

Carrier motor 30 includes a rotatable carrier motor shaft 34, which is attached to driven pulley 36 that provides movement to carrier transport belt 28. Carrier motor 30 is communicatively linked to controller 38 by way of communication link 32. Controller 38 directs the velocity and the direction of rotation of motor 30, which may be a servomechanism, a DC motor or a stepper motor. Controller 38 includes a processor and associated memory for coordinating the operations of ink jet printer 14. At a directive of controller 38, carrier 20 is transported in a reciprocating manner along guide rods 26. Controller 38 is communicatively linked to computer 12, printheads 62, 64, 66 and 68, carrier motor 30, drum motor 44 and position sensor 56.

Transfer system 40 includes an intermediate transfer member 42, a drum motor 44 and a communications link 46. Intermediate transfer member 42 may be embodied as an intermediate transfer belt 42 or as an intermediate transfer drum 42. Intermediate transfer drum 42 is rotatably mounted to frame 18. Intermediate transfer drum 42 is driven by drum motor 44 in a rotational manner. Printheads 62, 64, 66 and 68 print an image on intermediate transfer drum 42 under the control of controller 38. Drum motor 44 drives and controls the rotational speed of intermediate transfer drum 42. Intermediate transfer drum 42 has a surface velocity which is associated with the rotational speed of drum motor 44. Communications link 46 transfers commands to drum motor 44 for the controllable rotation of intermediate transfer drum 42. Shaft 48 is connected to intermediate transfer drum 42 as well as frame 18 and drum motor 44.

Error correction system 50 includes error table memory 52 and position detection apparatus 54. Error correction system 50 detects a position of intermediate transfer drum 42 and applies an error correction method, such as utilizing a value from error table memory 52 to modify the detected position of intermediate transfer drum 42, and directs drum motor 44 to appropriately position intermediate transfer drum 42 in the correct rotational position. The position that is detected by position detection apparatus 54 is translated to a signal that is transferred over communication link 58 to controller 38. Controller 38 combines the detected position, represented by the signal, and the value assigned as an error entry in error table memory 52, relative to the position represented by the signal, to thereby produce corrected position information. Controller 38 thereby has the information necessary to properly direct drum motor 44 to a properly position intermediate transfer drum 42. For each printing position, represented by line L1 and L2, which are representative of horizontal lines printed on intermediate transfer drum 42, such as black or color ink lines, an error entry in the form of a value is contained in error table memory 52. Each error entry corresponds to a position detected by a position detection apparatus 54. Alternatively, each error entry in error table memory 52 may be associated with a range of positions detected by position detection apparatus 54.

Position detection apparatus 54 includes a position sensor 56, a communications link 58 and an encoded disk 60. Position sensor 56 detects the rotational position of intermediate transfer drum 42 by reading positional information from encoded disk 60. Information from position sensor 56 is transferred to controller 38 by way of communication link 58. Encoded disk 60 is mounted to shaft 48 and rotates along with shaft 48. Whereas shaft 48 is connected to intermediate transfer drum 42 there is a correspondence in the angular position of encoded disk 60 and intermediate transfer drum 42. Position sensor 56 reads the relative rotational position of encoded disk 60 to thereby determine the corresponding position of intermediate transfer drum 42. While every attempt is made to properly position encoded disk 60 on shaft 48, misalignment or an off-center condition can exist. Such a condition will introduce an error into the determination of the angular position of encoded disk 60.

Figure 3:
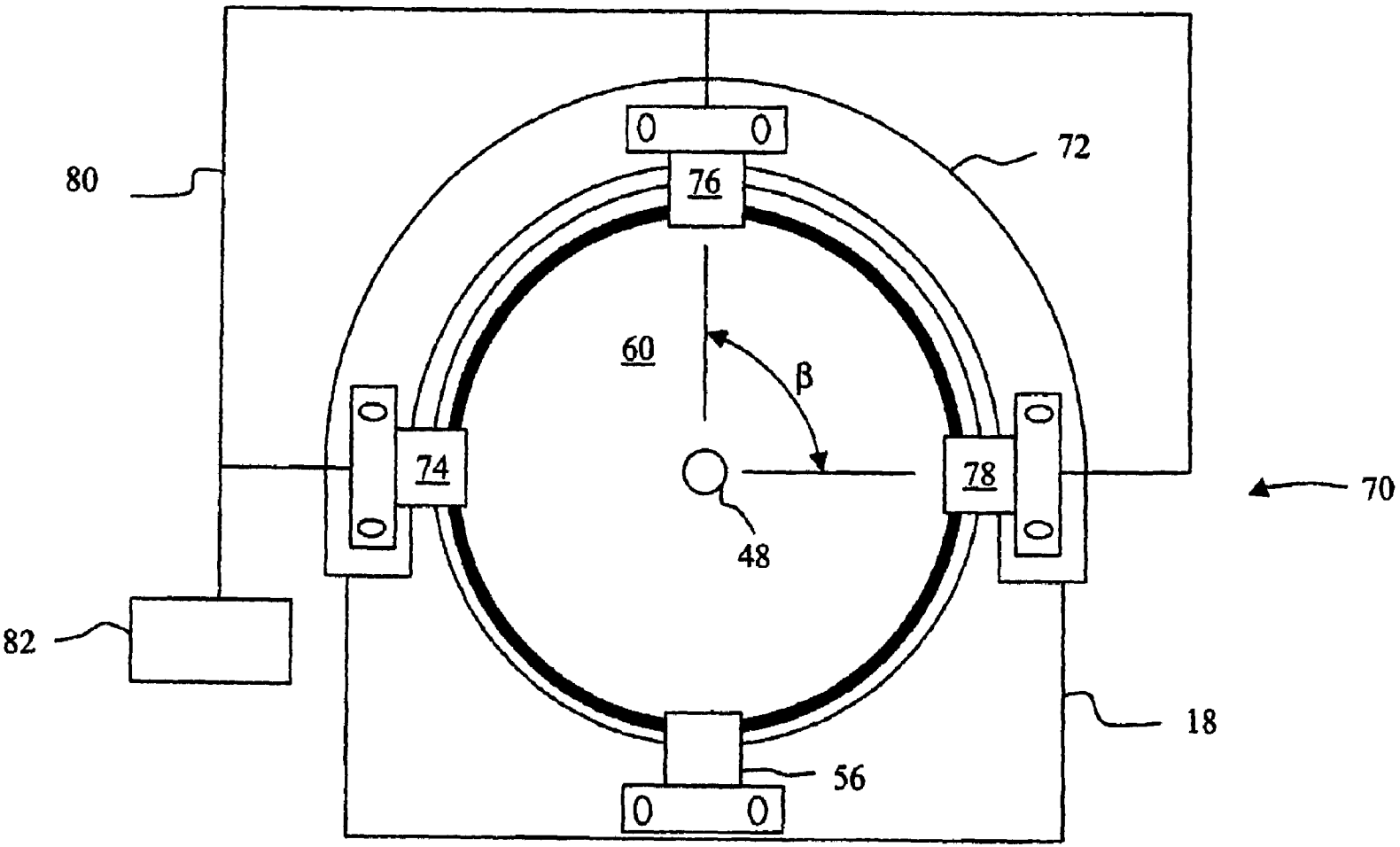
FIG. 3 is side diagrammatic representation of a calibration device associated with the printer of FIGS. 1 and 2.

Now additionally referring to FIG. 3, there is shown a calibration device 70 including a calibration flame 72, position sensors 74, 76 and 78, communication links 80 and a connector 82. Calibration device 70 is removably positioned in printer 14 about a portion of encoded disk 60 to provide additional positional information by way of communication links 80 and connector 82 to controller 38. Communications with controller 38 are temporarily established through the connection of connector 82 with connector 84. Connector 84 is communicatively linked to controller 38 by way of communications link 86. The positioning of calibration device 70 is indexed so that it is interfaced with frame 18 and accurately positions calibration device 70 relative to encoded disk 60. Calibration device 70 may be used in a factory calibration system in order to provide error values for error table memory 52.

Figure 4:
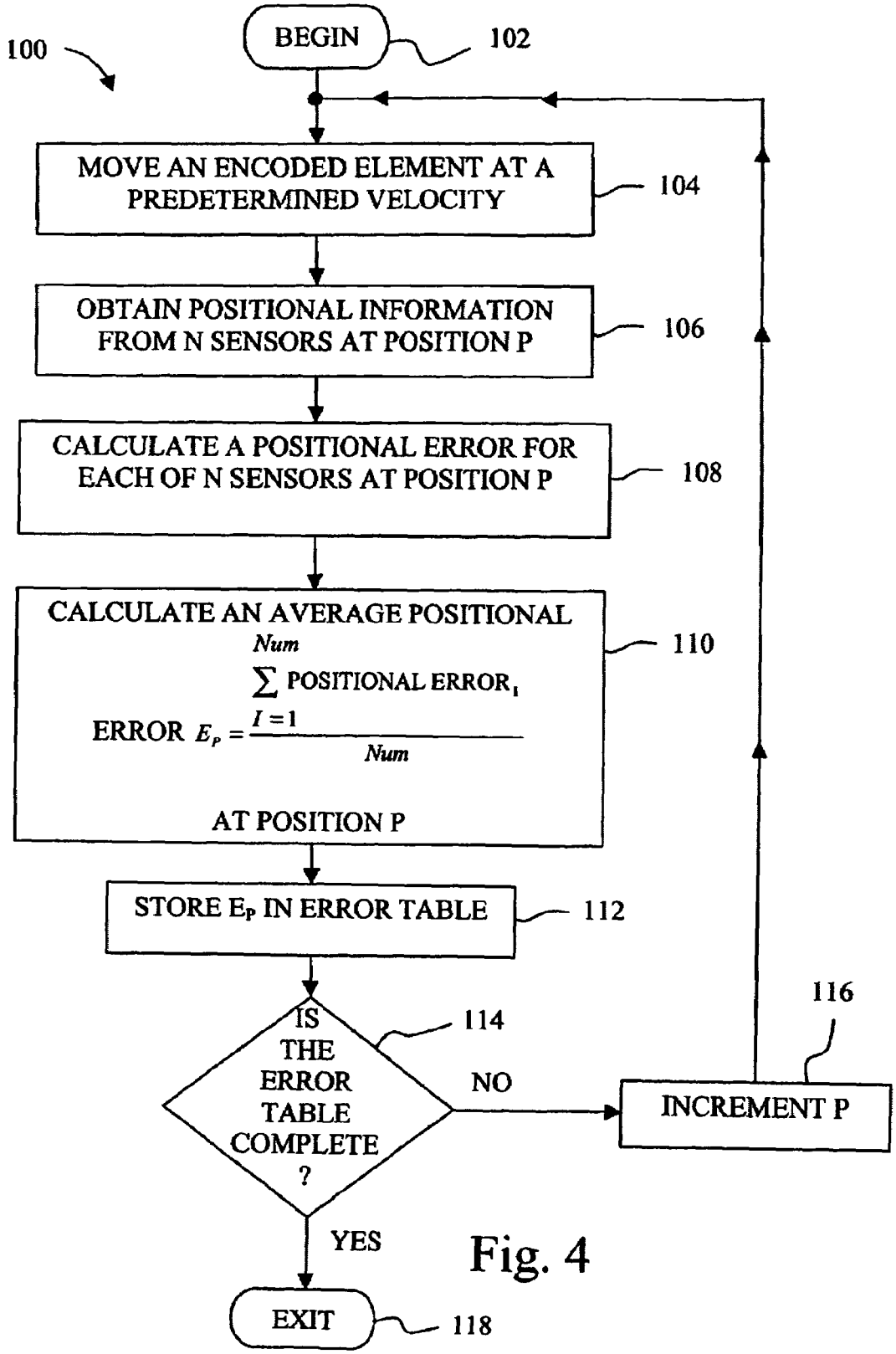
FIG. 4 is a block diagram of one embodiment of the present method associated with the printer of FIGS. 1–3.

Now, additionally referring to FIG. 4, there is shown an embodiment of the present invention including an error correction method including a method for obtaining positional error values for inclusion in error table memory 52. The method of FIG. 4 is depicted by a plurality of processing steps, hereinafter referred to as process 100, which may be executed by controller 38. Alternatively, process 100 can be executed by computer 12 as it interacts with ink jet printer 14. Another alternative is that process 100 can be executed by another computer, not shown, which may fill error table memory 52 such as by way of a process completed at a factory calibration site. Process 100 is used to fill an error table, which can then be used to reduce the color plane alignment error in a drum printer.

Process 100 begins at entry point 102. At step 104, controller 38 communicates with drum motor 44 and moves intermediate transfer drum 42 at a predetermined velocity or to a position P. The predetermined velocity may be a velocity that differs from that normally used to move intermediate transfer drum 42 during printing operations.

At step 106, positional information is obtained from encoded disk 60. Positional information from multiple sensors is gathered. The positional information obtained may be stored or used in real time to determine the position of encoded disk 60.

At step 108, a positional error is calculated for sensor 56 for position P. The calculated positional error is arrived at by averaging the positions detected by sensors 56, 74, 76 and 78. The position detected by sensors 74, 76 and 78 are appropriately offset for the geometric positioning of each sensor relative to sensor 56 before averaging.

At step 110, an average positional error $E_p$ is calculated by taking the positional error at position P and summing it for the number of readings taken for each position P. The number of readings Num for each position P, one for each revolution of encoded disk 60, is then divided into the sum of positional errors at position P. The number of readings Num is related to the number of readings taken at a position P.

At step 112, the average positional error $E_p$ is stored in an error table in error table memory 52.

At step 114, it is determined whether the error table is complete. An error table is complete when an error value has been stored for each position P. Alternatively, the error table may be complete when an error entry is available for at least a range of positions P of encoded disk 60. If the error table is complete, then process 100 continues to step 118 and exits. If the error table is not complete at step 114, then process 100 continues to step 116.

At step 116, the position P for which positional information would be obtained is incremented and the process returns to the point of beginning or step 104.

The foregoing method can be used with multiple position sensors such as position sensors 56, 74, 76 and 78 permanently mounted in ink jet printer 14. The average positional variation is then calculated, as in step 108, as encoded disk 60 moves and the average positional information used in real time, rather than utilizing error table memory 52. Alternatively, calibration device 70 can be installed in ink jet printer 14 on a temporary basis for the filling of error table memory 52, thereby only requiring the presence of positional sensors 74, 76 and 78 during a calibration time period, such as during the manufacturer of ink jet printer 14. The positioning of four sensors at equal angular spacing provides sufficient information to cancel out errors that occur at all integral frequencies except multiples of four. In a similar fashion, using other numbers of evenly spaced sensors will eliminate errors at other frequencies. Using two sensors located 180° from each other eliminates errors at all odd frequencies. Using three sensors at 120° apart from each other eliminates errors at frequencies which are not multiples of three cycles per revolution. In general, using N sensors at a spacing of 360° divided by N equals the angular separation in degrees, which eliminates all cyclical errors but those that are the multiples of N cycles per revolution.

The embodiment illustrated in FIG. 4 requires that several sensors be placed in a machine either temporarily or permanently in order to average the reading to minimize the error. If four sensors are used, as illustrated in FIG. 3, all sensors are spaced at a given angle β from one another, and that the angular position error has a frequency of F cycles per revolution at a phase angle of N and with an amplitude of A. The formula for the error seen by sensor N at disk rotary position P is:

$$E_N = A*\sin(FP+N+F\beta N)$$

At every position P, take the average of all 4 sensors:

$$\begin{aligned} E_{average} &= [A*\sin(FP+N)+A*\sin(FP+N+F\beta)+ \\ &\quad A*\sin(FP+N+2F\beta)+A*\sin(FP++3F\beta)]/4 \\ &= A[\sin(FP+N)+\sin(FP+N+F\beta)+ \\ &\quad \sin(FP+N+2F\beta)+\sin(FP++3F\beta)]/4 \end{aligned}$$

Choose β=π/2(90° spacing between sensors).
For F=1 cycle/revolution:

$$\begin{aligned} E_{average} &= A[\sin(P+N)+\sin(P+N+\pi/2)+\sin(P+N+\pi)+ \\ &\quad \sin(P+N+3\pi/2)]/4 \\ &= A[\sin(P+N)+\sin(P+N+\pi/2)-\sin(P+N)- \\ &\quad \sin(P+N+\pi/2)]/4 \\ &= 0 \end{aligned}$$

For F=2 cycles per revolution:

$$\begin{aligned} E_{average} &= A[\sin(2P+N)+\sin(2P+N+\pi)+\sin(2P+N+2\pi)+ \\ &\quad \sin(FP+N+3\pi)]/4 \\ &= A[\sin(2P+N)-\sin(2P+N)+\sin(2P+N)- \\ &\quad \sin(2P+N)]/4 \\ &= 0 \end{aligned}$$

For F=3 cycles per revolution:

$$\begin{aligned} E_{average} &= A[\sin(3P+N)+\sin(3P+N+3\pi/2)+ \\ &\quad \sin(3P+N+3\pi)+\sin(3P+N+9\pi/2)]/4 \\ &= A[\sin(3P+N)+\sin(3P+N+3\pi/2)-\sin(3P+N)- \\ &\quad \sin(3P+N+3\pi/2)]/4 \\ &= 0 \end{aligned}$$

However, for F=4 cycles per revolution:

$$\begin{aligned} E_{average} &= A[\sin(4P+N)+\sin(4P+N+2\pi)+\sin(4P+N+3\pi)+ \\ &\quad \sin(4P+N+6\pi)]/4 \\ &= A[\sin(4P+N)+\sin(4P+N)+\sin(4P+N)+ \\ &\quad \sin(4P+N)]/4 \\ &= A\ \sin(4P+N) \end{aligned}$$

Figure 6:
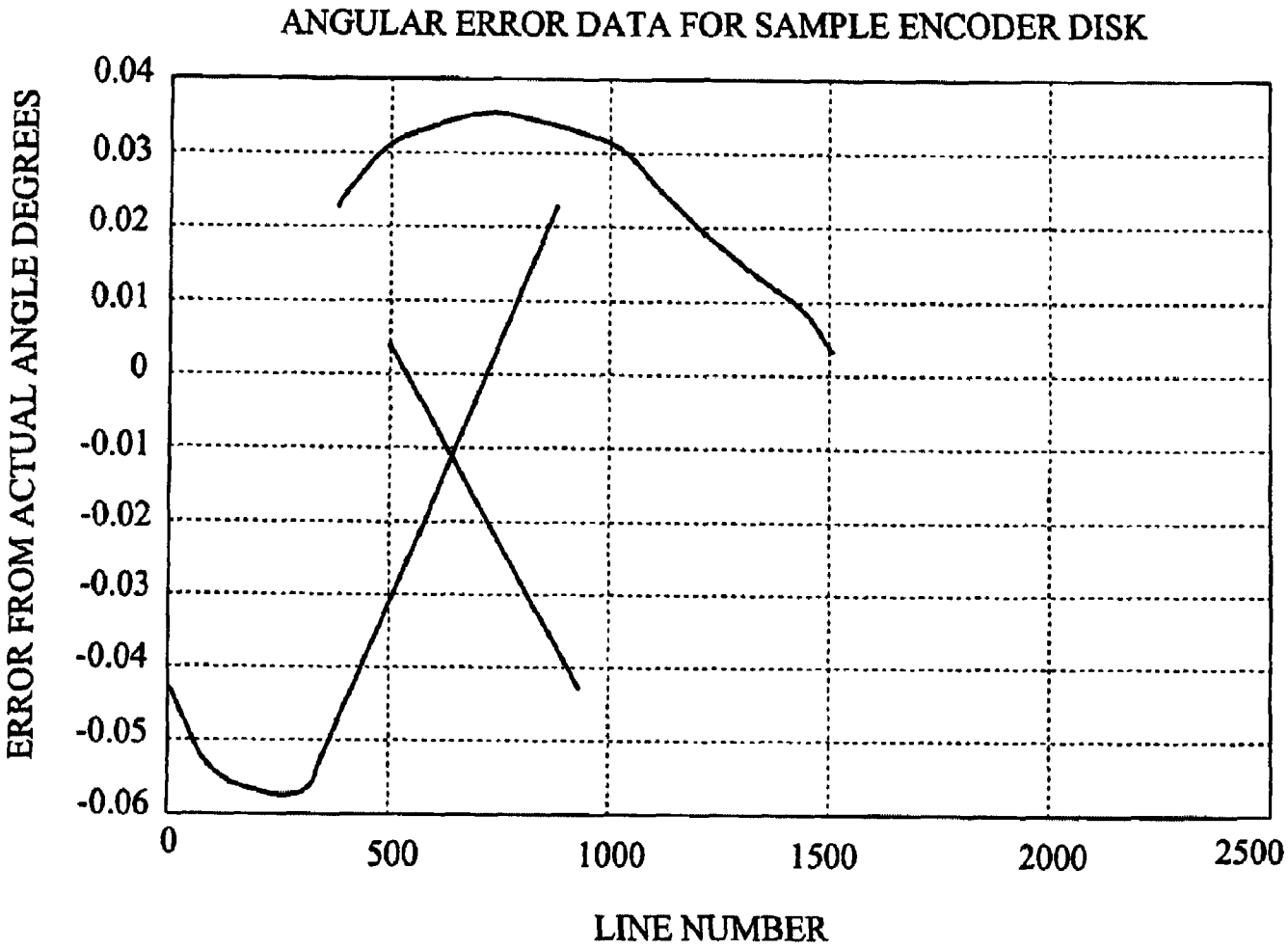
FIG. 6 is an illustration of angular error data for a sample encoder disk used in the printer of FIGS. 1–3.

So disturbances occurring at 1 to 3 cycles per revolution will be eliminated by averaging four sensors at 90° spacing around encoded disk 60. Furthermore, it can also be shown at errors that occur at all integral frequencies except multiples of four (4×, 8×, 12×, 16×, etc.) will be eliminated through this averaging process. Angular error data for a sample encoded disk is illustrated in FIG. 6, wherein a single cycle of error is shown for a disk that has 2,400 lines of encoding. The 2,400 lines representing one revolution of encoded disk 60. This single cycle is the primary type of error encountered with encoded disks. Typical errors can exceed one cycle per revolution; however, experimentation with encoded disks indicates nearly all errors can be accounted for in one to three cycles per revolution.

The error information thus obtained can be used immediately in the situation when there are multiple position sensors as shown FIG. 3 wherein the average positional error is simply calculated for each position P of encoded disc 60. The resulting information being used to indicate the true position of intermediate transfer drum 42.

Since having several positional sensors in printer 14 may be expensive the inclusion of error table memory 52 allows the positional error information generated by calibration device 70 to be input into error position table memory 52. Then calibration device 70 can be removed and all of the positional information then coming from position sensor 56 is modified by the error information contained error able memory 52 to thereby predict the true position of intermediate drum 42.

Figure 5:
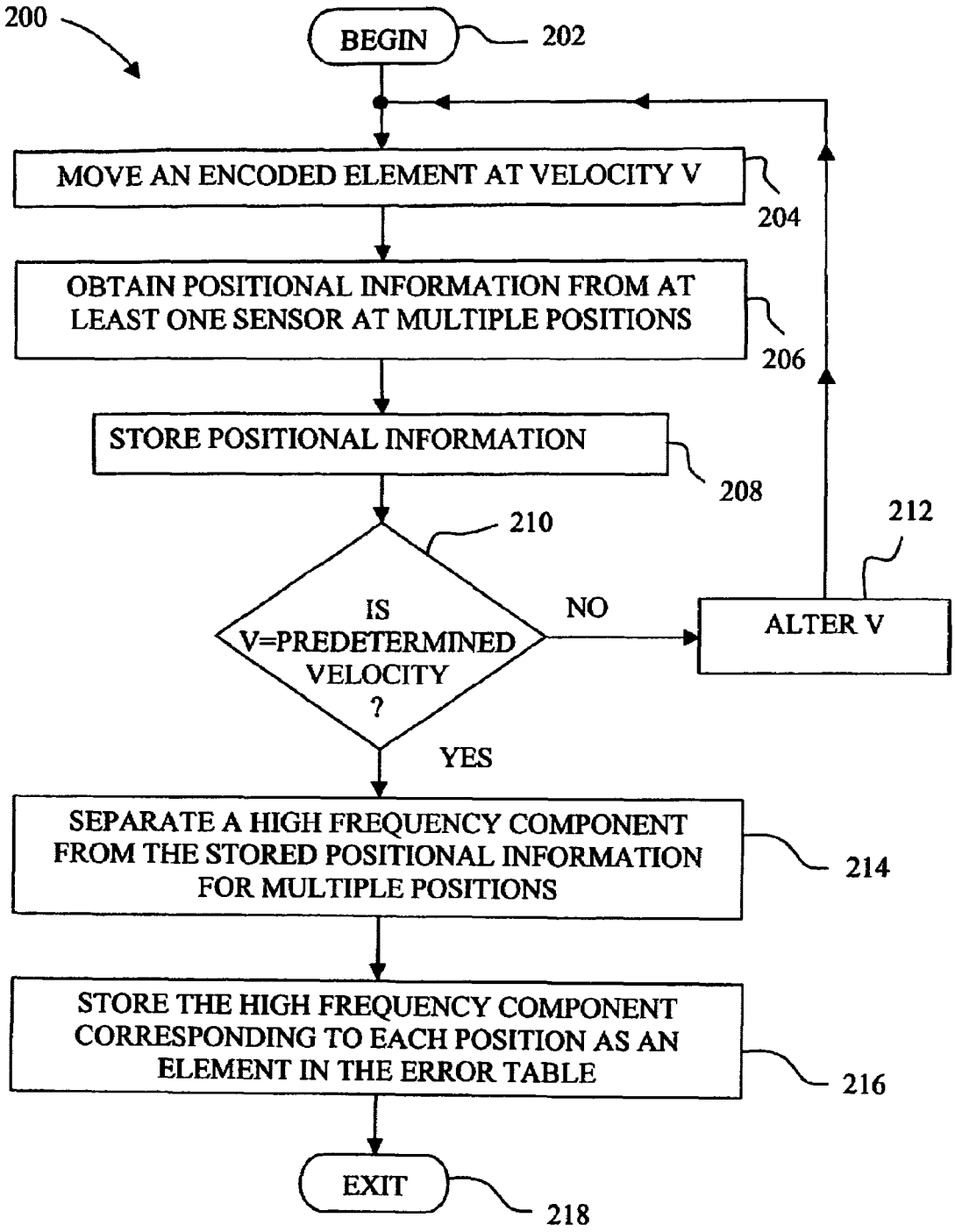
FIG. 5 is a block diagram of another embodiment of the method of the FIG. 5 present invention utilized in the printer of FIGS. 1–3.

Now, additionally referring to FIG. 5, there is shown process 200, which is another embodiment of the present invention wherein intermediate transfer drum 42 is spun open loop at several velocities and a high frequency component of the position signal is separated from the average drum velocity. The high frequency component for each position P is then treated as the position error. Process 200 begins at entry point 202.

At step 204, encoded disk 60 is rotated at velocity V. The rotation of encoded disk 60 is accomplished by controller 38 instructing drum motor 44 to spin at a constant velocity V. It is assumed that intermediate transfer drum 42 has sufficient mass to spin at the predetermined velocity without significant variation.

At step 206, positional information is obtained from at least one sensor at multiple positions. The information obtained for each position P from position sensor 56 is transferred to controller 38.

At step 208, controller 38 stores positional information obtained in step 206. Positional information 108 may be stored in memory associated with controller 38 or on computer 12 by way of a transfer over a communication link 16. Information thus stored is available for later analysis to develop error values for entry into the error table.

At step 210, it is determined if velocity V is equal to a predetermined velocity. If velocity V is not equal to a predetermined velocity then process 200 proceeds to step 212. If velocity V is equal to the predetermined velocity then process 200 proceeds to step 214.

At step 212, it having been decided at step 210 that velocity V is not the predetermined velocity, velocity V is altered to a new velocity V in an open loop fashion and process 200 proceeds to step 204.

At step 214, it having been decided at step 210 that velocity V is equal to predetermined velocity, then process 200 separates a high frequency component from the positional information for multiple positions of encoded disk 60. The separation of high frequency components may be done by way of a Fourier transform. The Fourier transform of the positional information separates error magnitudes for separate frequencies corresponding to each velocity of intermediate transfer drum 42.

At step 216, the high frequency component calculated in step 214 is stored in error table memory 52 for each position P as an element in the error table.

This method advantageously allows positional errors of intermediate drum 42 and encoded disk 60 to be detected and error table memory 52 to be refreshed over the life of ink jet printer 14 without user intervention. Process 200 may be initiated automatically after a predetermined time or page count. Alternatively, process 200 may be initiated by a user command from a control panel on printer 14 or by way of a window interface on computer 12.

Also, advantageously the angular error data for a sample encoded disk, such as that illustrated in FIG. 6, is detected and removed by the foregoing methods of the present invention.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A device for use in an imaging system:

a rotatable device configured for rotation;

a reference apparatus associated with said rotatable device;

a memory including an error table having a plurality of error entries; and a position detection apparatus coupled to said rotatable device, said position detection apparatus having at least one position sensor, said at least one position sensor interacting with said reference apparatus to produce a position signal, said position detection apparatus combining said position signal with at least one of said plurality of error entries of said error table, to thereby produce an output signal representative of a substantially true position of said rotatable device; and a calibration device temporarily connected to said position detection apparatus, said calibration device interacting directly with said reference apparatus and said calibration device interacting with said at least one position sensor to establish said error table, said calibration device including at least two position sensors detecting a position of said rotatable device.

2. The device of claim 1, wherein said at least one position sensor includes a first position sensor, a second position sensor and a third position sensor, each located at predetermined positions relative to each other.

3. The device for use in an imaging system of claim 2, wherein said position detection apparatus further comprises an encoded element, said encoded element connected to said rotatable device, said encoded element located so as to interact with said first position sensor, said second position sensor and said third position sensor.

4. The device for use in an imaging system of claim 3, wherein said encoded element is an encoder disk and said first position sensor is an optical sensor.

5. The device for use in an imaging system of claim 1, wherein said at least one position sensor is a plurality of position sensors, said plurality of position sensors producing a corresponding plurality of position signals, said plurality or position signals being mathematically combined to produce said output signal.

6. The device for use in an imaging system of claim 5, wherein said plurality of position signals are averaged together to produce said output signal.

7. The device for use in an imaging system of claim 1, wherein said at least one position sensor includes a first position sensor, said calibration device including at least one additional position sensor as a second position sensor, said first position sensor being substantially similar to said second position sensor.

8. The device for use in an imaging system of claim 7, wherein said first position sensor and said second position sensor are arranged in a predetermined geometric pattern relative to each other.

9. The device for use in an imaging system of claim 8, wherein said position detection apparatus further comprises an encoder disk, said first position sensor and said second position sensor being arranged at substantially equidistant angles along a circumference of said encoder disk.

10. The device for use in an imaging system of claim 1, wherein said at least one position sensor comprises a plurality of position sensors N, and said position detection apparatus further comprises an encoder disk, said plurality of position sensors being arranged in substantially equal angles θ relative to said encoder disk, wherein an error value $E_N$ is calculated for a plurality of positions of said encoder disk, said error value $E_N$ for each of said position sensors is calculated using the formula: $E_N = A*\sin(FP+\phi+F\theta N)$, wherein said error value $E_N$ has a frequency of F cycles per revolution at a phase angle of ϕ with an amplitude of A, N being an individual index number assigned to each of said sensors.

11. The device for use in an imaging system of claim 10, wherein an average error $E_{ave}$ is calculated for each of said plurality of positions, said average error $E_{ave}$ being calculated as:

$$E_{ave} = \frac{\sum E_N}{\text{Total } N}, \text{ for } N = 1 \text{ to Total } N,$$

where Total N is the total number of position sensors.

12. The device for use in an imaging system of claim 11, wherein said average error Eave for each of said plurality of positions is stored in said non-volatile memory as said error table.

13. The device for use in an imaging system of claim 1, further comprising:

a controller communicatively connected to said position detection apparatus; and a printhead communicatively connected to said controller, said controller configured to receive said output signal and to utilize said output signal to determine when to command said printhead to eject ink.

14. A method of generating an error table for use in a positioning system of a printer, comprising the steps of:

providing a rotatable device including an encoded element;

moving said encoded element;

detecting a plurality of positions of said encoded element by way of at least one sensor;

producing a plurality of position signals corresponding respectively to each of said plurality of positions;

calculating at least one positional error from said plurality of position signals;

storing said at least one positional error as an element in the error table; and temporarily connecting a calibration device in the printer, said calibration device having at least two position sensors including a second sensor and a third sensor, said second and said third sensor each producing one of said position signals, said at least two position sensors positioned to interface directly with said encoding element.

15. The method of claim 14, wherein said encoded element is connected to a transfer drum, said moving step being accomplished by rotating said transfer drum at a plurality of velocities in an unloaded state.

16. The method of claim 14, wherein said calculating step mathematically combines said signal from said first sensor, said signal from said second sensor and said signal from said third sensor to calculate said positional error.

17. A method of generating an error table for use in a positioning system of a printer, comprising the steps of:

providing a rotatable device including an encoded element;

moving said encoded element;

detecting a position of said encoded element by way of at least one sensor including a first sensor;

producing at least one signal from said first sensor;

calculating at least one positional error from said at least one signal;

temporarily coupling a calibration device directly to said encoded element to thereby provide additional signals to said calculating step for the production of said at least one positional error; and storing said at least one positional error as an element in the error table.

18. The method of claim 17, further comprising the step of determining a high frequency component of said at least one signal.

19. The method of claim 18, further comprising the step of storing said high frequency component as said positional error in an element in the error table.

* * * * *